United States Patent [19]

Baron et al.

[11] Patent Number: 4,464,093

[45] Date of Patent: Aug. 7, 1984

[54] POWER SHOVEL HAVING IMPROED HOIST SYSTEM

[75] Inventors: George B. Baron; George J. Thompson, both of Marion, Ohio

[73] Assignee: Dresser Industries, Inc., Dallas, Tex.

[21] Appl. No.: 950,005

[22] Filed: Oct. 6, 1978

[51] Int. Cl.[3] ..... E02F 3/32

[52] U.S. Cl. ..... 414/687; 15/405; 212/238

[58] Field of Search ..... 414/694, 695, 722, 723, 414/727, 692, 709, 714, 700, 685, 707, 719, 687, 732, 733, 743, 738, 487, 405; 37/1, 103, 117.5, 116, 118, 118 A, 126, 137; 212/238, 232

[56] References Cited

U.S. PATENT DOCUMENTS

| | | | |
|---|---|---|---|
| 2,639,826 | 5/1953 | Welden | 414/732 |
| 3,080,076 | 3/1963 | Randall | 414/694 |
| 3,501,034 | 3/1970 | Baron | 414/694 |
| 3,506,145 | 4/1970 | Rupert | 414/694 |
| 4,046,270 | 9/1977 | Baron et al. | 414/694 |

*Primary Examiner*—Frank E. Werner

*Attorney, Agent, or Firm*—Lalos, Leeds, Keegan, Lett, Marsh, Bentzen & Kaye

[57] ABSTRACT

A power shovel generally consisting of a support unit, a stiffleg operatively connected to the support unit for pivotal movement about a stiffleg pivot axis, a handle operatively connected to the stiffleg for pivotal movement about a handle pivot axis, a dipper mounted on the handle, a crowd system operatively connected to the handle for crowding and retracting the dipper and a hoist system for hoisting and lowering the dipper comprising at least one upper fluid actuated rod and cylinder assembly operatively connected at a lower end to the stiffleg and operatively connected at an upper end thereof to the handle on one side of the handle pivot axis, at least one lower fluid actuated rod and cylinder assembly operatively connected at a lower end thereof to the stiffleg and operatively connected at an upper end thereof to the handle on a side opposite to the operative connection of the upper end of the upper fluid actuated assembly to the handle, relative to the handle pivot axis, and apparatus for selectively supplying fluid under pressure to opposite ends of the fluid actuated assemblies to effect an extension and retraction of the rods of the fluid actuated assemblies to correspondingly effect a pivotal movement of the handle about the handle pivot axis.

22 Claims, 5 Drawing Figures

94d
93d
94c
93c
41
39
94e
40
38
92d
91d
92c
93e
91c
94
94a
93
34
93a
27
25
28
91e
92e
94b
29
23
92
93b
22
91
47
46a
32
92a
101
91a
46
52
26
24
92b
46b
51
50
55
46c
91b
48a
53
54

POWER SHOVEL HAVING IMPROVED HOIST SYSTEM

BACKGROUND OF THE INVENTION

This invention relates to power shovels and more specifically to a power shovel having an improved hoist system. This invention particularly is applicable to large, heavy-duty mining shovels of the type disclosed in U.S. Pat. Nos. 3,501,034; 3,648,863; 3,933,260 and 3,990,161.

In conventional, heavy-duty mining shovels, usually there is provided a lower frame provided with a propulsion unit, a rotatable upper frame mounted on the lower frame, a stiffleg operatively connected to the upper frame, a handle operatively connected to the stiffleg, a dipper mounted on the handle, a system for crowding the dipper and a system for hoisting the dipper. Typically, the hoist system of such type of shovel consists of a rope assembly, generally including a hoist drum mounted on the upper frame, driven by motor-generator sets through heavy-duty gear trains, sheaves mounted on the front assembly of the machine and a rope wound on the hoist drum, reeved on the sheaves and dead-ended at the foot of the stiffleg. By paying out and taking in the hoist rope, the handle can be pivoted relative to the stiffleg to hoist and lower the dipper.

Hoist systems of the type described have several disadvantages. Initially, there are the original and replacement costs of the motor-generator sets, the heavy-duty gearing, the hoist drum, the sheaves and the ropes, which are substantial. Secondly, there is the disadvantage of the requirement for space of the hoist system components mounted on the upper frame. The motor-generator sets, gearing and hoist drum normally are mounted on the upper deck which usually is congested with other components of the machine including structural components of the housing and operator's cab, the crowd machinery, the swing machinery, the propulsion machinery and various auxiliary systems and equipment. Rope wear and fouling also are disadvantages of rope hoist systems which result in increased down time for repair and maintenance. It thus has been found to be desirable to provide an improved front end assembly for power shovels, particularly for large, heavy-duty mining shovels, and specifically to provide an improved hoist system which would mitigate if not entirely eliminate the aforementioned disadvantages of rope hoist systems.

OBJECTS OF THE INVENTION

Accordingly, it is the principal object of the present invention to provide a novel power shovel having an improved front end assembly.

Another object of the present invention is to provide a novel power shovel having an improved hoist system.

A further object of the present invention is to provide an improved hoist system for large, heavy-duty mining shovels.

A still further object of the present invention is to provide an improved hoist system for a power shovel eliminating the requirement for costly drums, heavy-duty gearing, sheaves and hoist ropes.

Another object of the present invention is to provide an improved hoist system for a power shovel which avoids traditional problems of rope wear and rope fouling.

A further object of the present invention is to provide an improved hoist system for a power shovel which reduces the static and dynamic loads imposed on the front end assembly of the shovel thus improving the stability and operating performance of the shovel.

A still further object of the present invention is to provide an improved hoist system for a power shovel which is comparatively simple in design, less expensive to manufacture and easier to service.

BRIEF DESCRIPTION OF THE DRAWINGS

Other objects and advantages of the present invention will become more apparent to those persons having ordinary skill in the art to which the present invention pertains, from the following specification, taken in conjunction with the accompanying drawings wherein.

DETAILED DESCRIPTION OF THE PREFERRED EMBODIMENT

Figure 1:
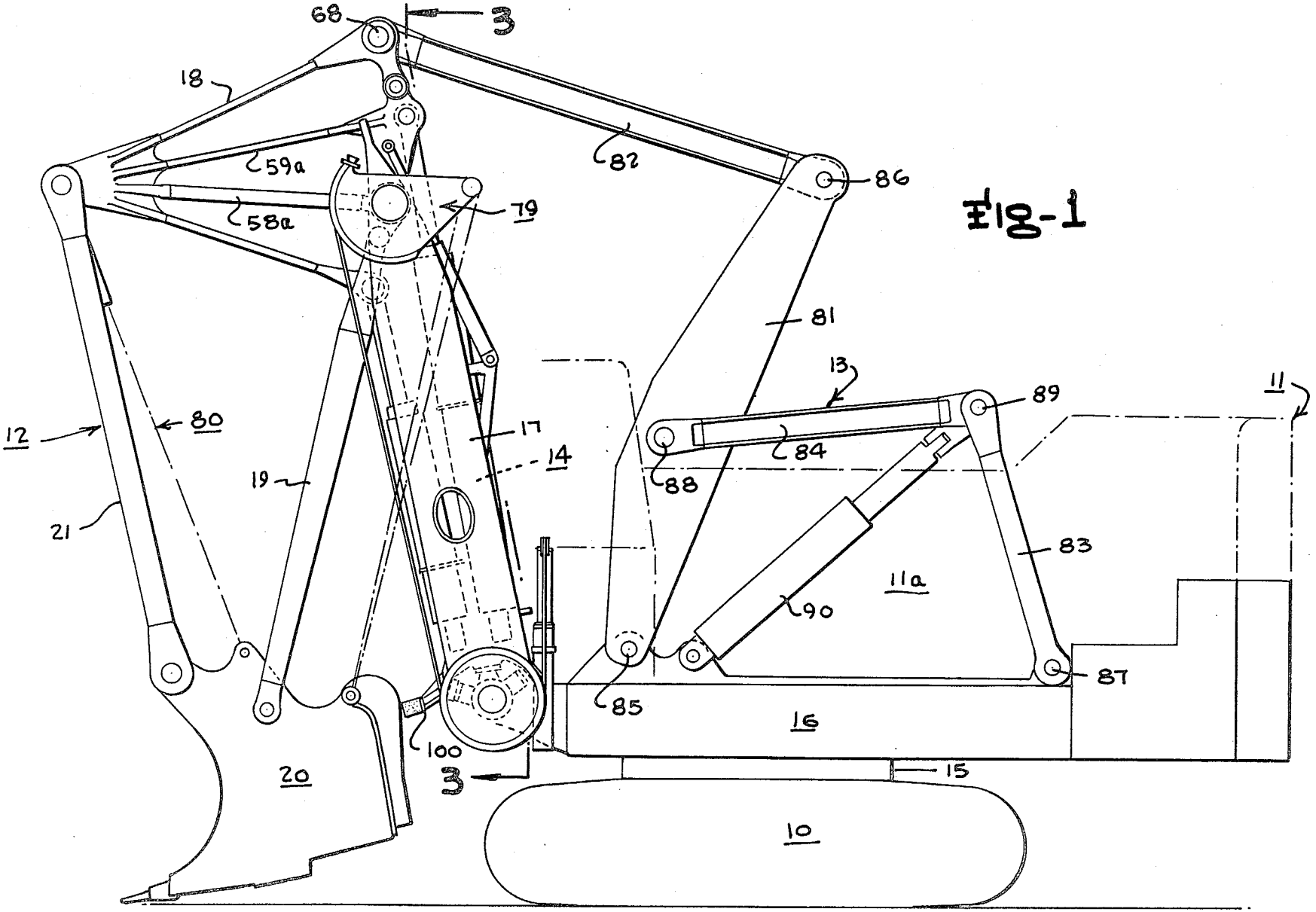
FIG. 1 is a side elevational view of a power shovel embodying the invention.

Referring to the drawings, there is illustrated an embodiment of the invention which generally includes a crawler unit 10, a main support unit 11 mounted on the crawler unit, a front end assembly 12 mounted on the front end of the main support unit, a crowd system 13 mounted on the main support unit and operatively connected to the front end assembly, a hoist system 14 mounted on the front end assembly, and a system mounted on the main support unit for operating the crowd and hoist systems.

Crawler unit 10 consists of a lower frame supported on a pair of conventional crawler assemblies, and a conventional roller circle 15 mounted on the lower frame. Main support unit 11 consists of an upper frame 16 rotatably mounted on the roller circle and a housing **11*a*** mounted on the upper frame, which houses certain components of the housing structure, the crowd system, the swing and propulsion machinery and other auxiliary systems and equipment.

Figure 2:
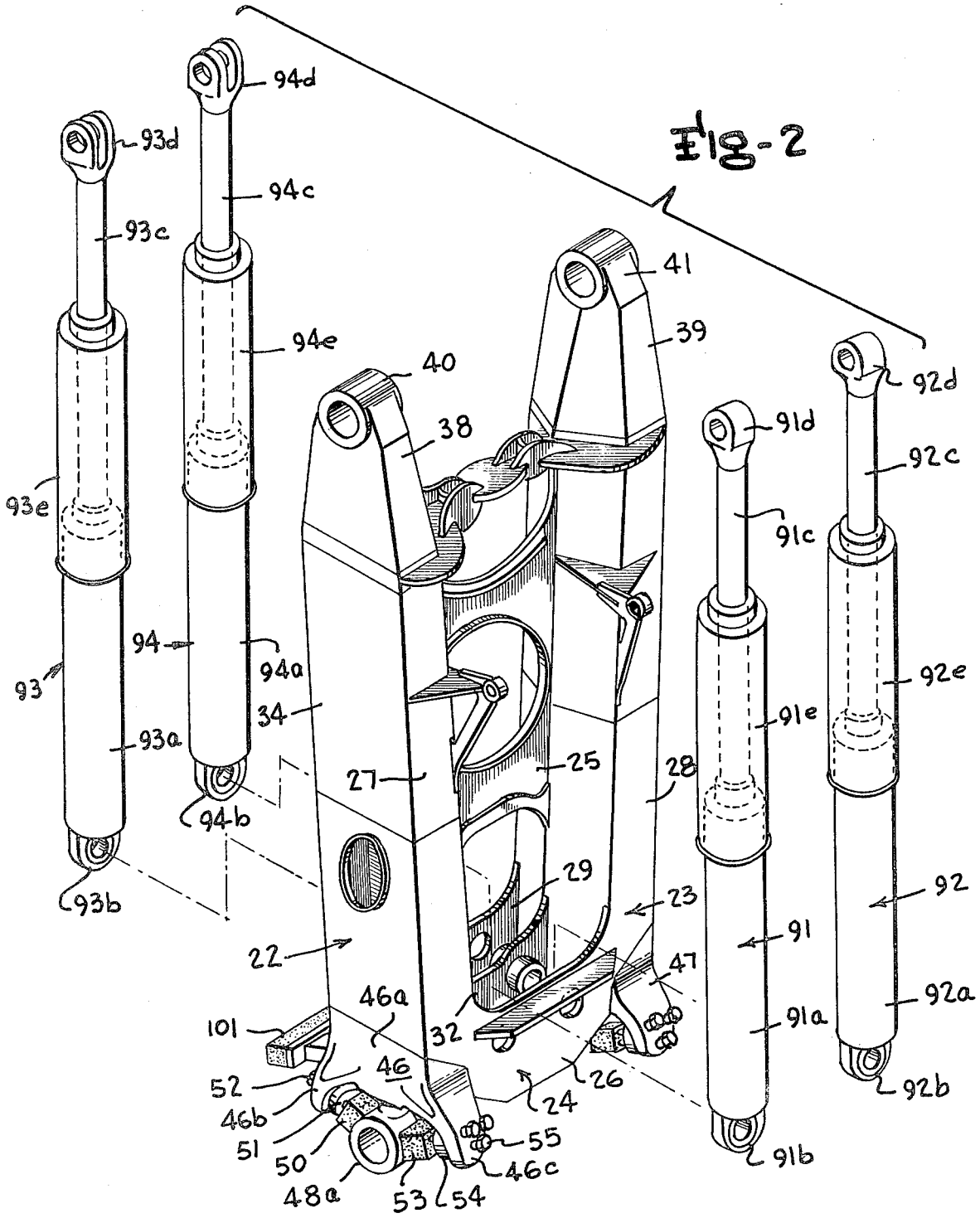
FIG. 2 is an exploded, perspective view of certain components of the invention.
Figure 3:
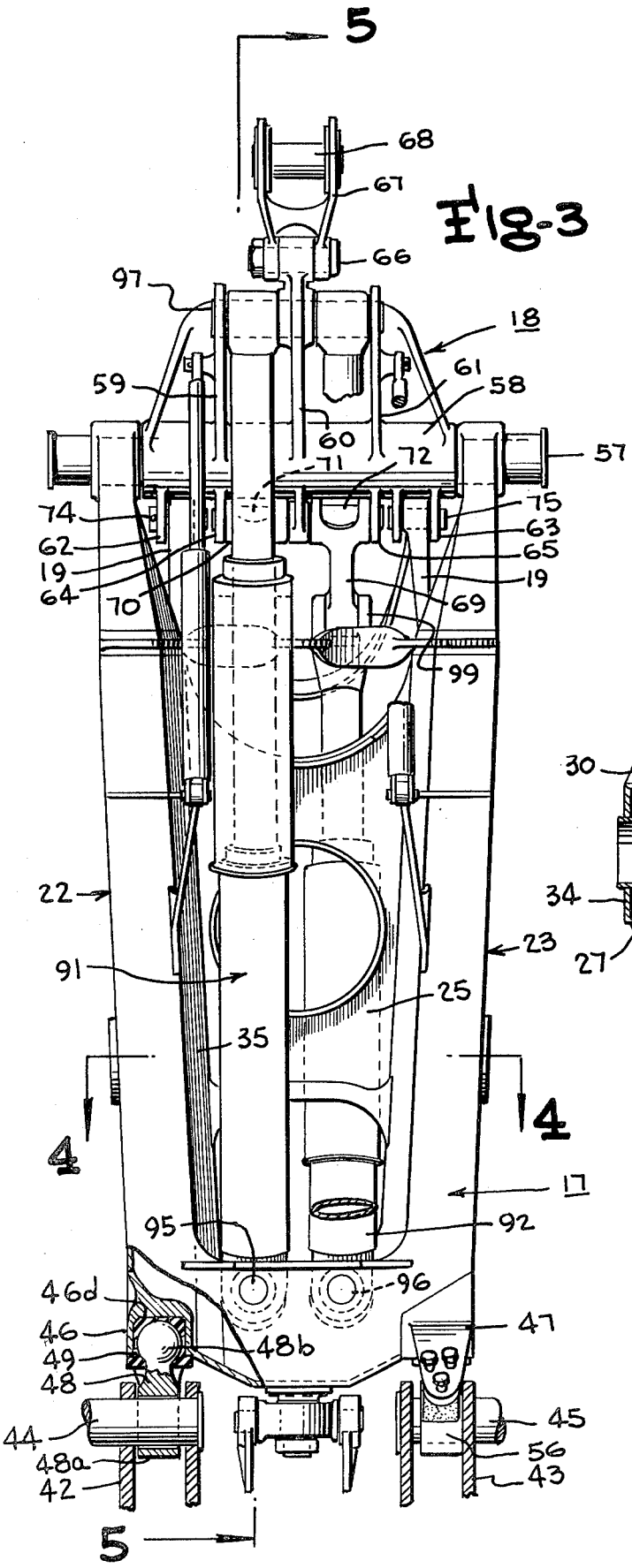
FIG. 3 is an enlarged cross-sectional view taken along line 3—3 in FIG. 1.
Figure 4:
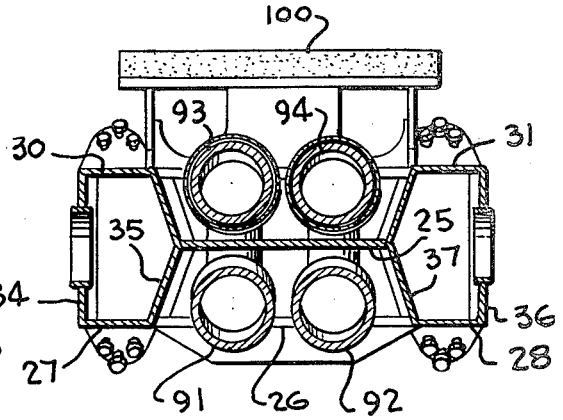
FIG. 4 is a cross-sectional view taken along line 4—4 in FIG. 3.

Front end assembly 14 generally includes a stiffleg 17, a hoist frame 18, a dipper handle 19, a dipper 20 and a hoist link 21. As best illustrated in FIGS. 2 and 3, the stiffleg consists of a pair of transversely spaced, longitudinally disposed box beam sections 22 and 23 joined together at their lower ends by a transversely disposed connecting section 24, forming a U-shaped structure, and a web section 25 interconnecting the box beam sections above connecting section 24. Section 24 is provided with an upper plate member 26 which merges with upper plate members 27 and 28 of beam sections 22 and 23, a lower plate member 29 which merges with lower plate members 30 and 31 of box sections 22 and 23, an intermediate plate member 32 disposed substantially parallel to plate members 26 and 29, interconnecting the lower ends of the box beam sections, and a lower end wall 33.

The box beam sections of the stiffleg are substantially similar in shape and construction. Box beam section 22 includes an outer wall member 34 and an inner wall member 35. Similarly, beam section 23 includes an outer wall member 36 and an inner wall member 37. Inner wall members 35 and 37 are provided with angularly disposed plate portions which are interconnected by web section 25 and intermediate plate member 32. The upper ends of the box beam sections are formed with end portions 38 and 39 on which there are mounted axially-aligned head shaft bearings 40 and 41.

The lower end of the stiffleg is trunion mounted on brackets 42 and 43 provided on the front end of upper frame member 16. The brackets are provided with aligned foot pins 44 and 45 on which there is mounted a pair of foot members 46 and 47. The foot members are substantially similar in construction and are formed integrally with the stiffleg at the lower corners thereof. As best illustrated in FIGS. 2 and 3, foot member 46 consists of a casting including a main body portion **46*a* and a pair of depending lug portions 46*b* and 46*c*, and a connecting link 48. Link 48 is provided with a cylindrical portion 48*a* pivotally mounted on foot pin 44 and a spherical portion 48*b* which is received within an oversized socket 46*d* provided on the underside of main portion 46*a* of foot member 46. Interposed between socket portion 48*b* and the walls of socket 46*d* is a stiff resilient material 49. Interposed between lug portion 46*b* and cylindrical portion 48*a* of link 48 is a resilient pad 50 and a backing pad 51. Lug portion 46*b* is provided with threaded openings through which there are threaded bolts 52 which engage backing pad 51. By threading bolts 52 down onto backing pads 51, resilient pad 50 will be urged into engagement with the outer side of cylindrical portion 48*a* of link 48. Similarly interposed between lug portion 46*c* and cylindrical portion 48*a* of link 48 is a resilient pad 53 and a backing pad 54. Bolts 55 are provided on lug portion 46*c* which engage backing pad 54 to urge resilient pad 53 into engagement with cylindrical portion 48*a* of link 48**.

As previously indicated, foot member 47 is similar in construction to foot member 46. A link 56 similar to link 48 is mounted on foot pin 45 and is provided with a spherical portion received within a socket of foot member 47 similarly as explained with respect to link 48. Resilient padding between the depending lug portions of foot member 47 and connecting link 56 is provided similar to the arrangement described in connection with foot member 46. With such a foot pin connection of the stiffleg to the front end of lower frame 16 of the machine, it will be appreciated that the stiffleg is adapted to pivot about the axis of foot pins 44 and 45, that loads in tension, compression and bending will be transmitted from the stiffleg through connecting links 48 and 56 and foot pins 44 and 45 to the upper frame of the machine and that each of the box beam sections will have limited universal movement relative to connecting links 48 and 56. Because of the design of the connection, it will be torsionally limber so that torsional loads applied to the stiffleg will be transmitted through the depending lug portions of the foot members, the cylindrical portions of the connecting links and the foot pins, into the main frame of the machine. The full impact of such torsional loads, however, will be alleviated by the cushioning material provided between the depending lug portions of the foot members and the cylindrical portions of the connecting links mounted on the foot pins.

Figure 5:
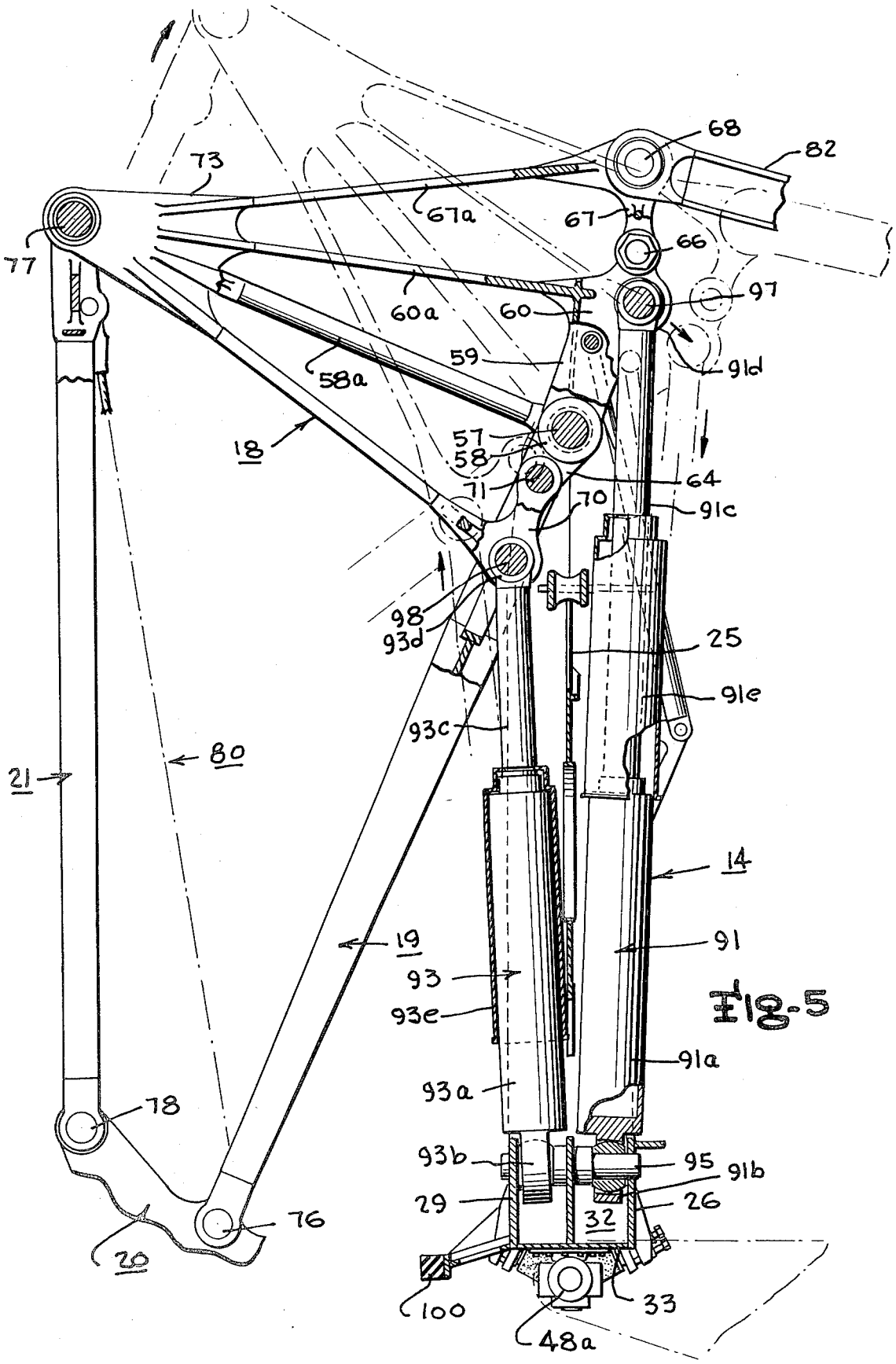
FIG. 5 is a cross-sectional view taken along line 5—5 in FIG. 3.

Journaled in bearings 40 and 41 at the upper end of the stiffleg is a head shaft 57 on which there is pivotally mounted hoist frame 18. Referring to FIGS. 3 and 5, hoist frame 18 includes a tubular base member 18 pivotally mounted on head shaft 57 which is provided with a set of substantially radially disposed lugs 59, 60 and 61. Formed on substantially the opposite side of lugs 59, 60 and 61 are outboard sets of ears 62 and 63 and an inboard set of ears 64 and 65. Secured to the outer end of lug 60 by means of a bolt and nut assembly 66 is a bifurcated crowd link connecting member 67 provided with a connecting pin 68. On the opposite side of base member 58, a pair of links 69 and 70 are pinned to base member 58 by means of a pair of axially aligned pins 71 and 72 provided on inboard sets of ears 64 and 65.

Formed integrally on the ends of base member 58 is a pair of converging struts **58*a* which are formed integrally at the outer ends thereof with a point casting 73. Lugs 59, 60 and 61 also are provided with struts 59*a*, 60*a* and 61*a* which are connected to point casting 73. Above strut 60*a*, a pair of struts 67*a* are formed integrally with and interconnect bifurcated crowd link connecting member 67 and point casting 73. Similarly, below struts 58*a*, a pair of struts 64*a* and 65*a* are formed integral with and interconnect links 64 and 65 and point casting 73**.

Handle 19 consists of a suitable structural member and is provided with upper and lower bifurcated ends. The upper bifurcated end is connected to the hoist frame by means of pins 74 and 75 provided in outboard sets of ears 62 and 63. It will be noted that the axis of pins 74 and 75 is displaced radially relative to the axis of head shaft 57 so that the pivot axis of the handle relative to the hoist frame is displaced relative to the pivot axis of the hoist frame relative to the stiffleg. Such arrangement alleviates congestion of components on the head shaft and reduces the bending forces on the head shaft as more fully described in U.S. Pat. No. 3,856,161. The lower bifurcated end of the stiffleg is pivotally connected to the upper rear end of dipper 20 by means of a pair of axially aligned pins 76.

Point member 73 and the upper front end of dipper 20 are connected by hoist link 21. The upper end of the hoist link is bifurcated and connected to point member 73 by means of a pivot pin 77. The lower bifurcated end of the hoist link is connected to the dipper by means of a pair of axially aligned connecting pins 78. As best illustrated in FIGS. 1 and 5, hoist link 18, handle 19, dipper 20 and hoist link 21 are pivotally connected together to provide a four-bar linkage with the link comprising the hoist frame being pivotally connected to the upper end of the stiffleg by means of head shaft 58. To provide a substantially flat pass of the dipper when it is crowded into a bank of material being excavated or loaded, there is mounted on the front end assembly a pitch control system 79, the construction and operation of which is fully described in U.S. Pat. Nos. 3,501,034 and 3,648,863. Furthermore, the front end assembly is provided with a pitch stop assembly 80, the construction and operation of which is fully described in U.S. Pat. No. 4,085,854.

The construction and operation of crowd system 13 is fully described in U.S. Pat. No. 4,046,270. Generally, it consists of a linkage arrangement and a fluid actuated system. As best seen in FIG. 1, the linkage includes a mast 81, a connecting link 82, a pair of transversely spaced support links 83 and a pair of transversely spaced, crowd drive links 84. Mast 81 consists of a pair of transversely spaced, side sections pivotally connected at their lower ends by means of pins 85 to mounting brackets 86 rigidly secured to the deck of upper frame unit 16, forwardly of the vertical center line of rotation of the upper frame, and cross-piece sections interconnecting the side sections between the upper and lower ends thereof. The forward end of connecting link 82 is pivotally connected to the upper end of hoist frame 18 by means of connecting pin 68. The rearward end of such link is connected to the upper end of mast 81 by means of a connecting pin 86. Support links 83 are pivotally connected at their lower ends to brackets rigidly secured to the deck of the upper frame unit by means of pins 87. The front ends of crowd drive links 84 are connected to mast 81 by means of pins 88. The rear ends thereof are connected to the upper ends of support links 83 by means of pins 89 to provide a four-bar linkage arrangement consisting of the upper frame unit, the lower end of mast 81, crowd drive links 84 and support links 83. Pivotally connected at their lower ends to the deck of the upper frame adjacent the lower end of mast 81 and pivotally connected at their upper ends to connecting pins 89 is a pair of fluid actuated rod and cylinder assemblies 90 which constitute a component part of the fluid actuating system. It will be appreciated that upon supplying fluid under pressure to opposite ends of the fluid actuated assemblies, the rods thereof will be extended and retracted to pivot support links 83 in vertical planes. The motion of support links 83 correspondingly will be transmitted through crowd drive links 84, mast 81 and connecting link 82 to the front end assembly of the machine consisting of the stiffleg, hoist frame, handle, dipper and hoist link to correspondingly crowd and retract the dipper.

Hoist system 14 consists of a pair of pull-type, hydraulically actuated rod and cylinder assemblies 91 and 92 operatively interconnecting the lower end of the stiffleg and an upper side of the hoist frame, a pair of push-type, hydraulically actuated rod and cylinder assemblies 93 and 94 operatively interconnecting the lower end of the stiffleg and a lower side of the hoist frame, and a suitable fluid supply system for supplying fluid under pressure to the cylinders of the assemblies. Referring to FIG. 2, it will be noted that assemblies 91 and 92 are substantially similar and that assemblies 93 and 94 are substantially similar. Assembly 91 is provided with a cylinder portion **91*a* having a mounting fixture 91*b* on the free end thereof, a rod portion 91*c* slidably mounted in cylinder portion 91*a* in the conventional manner, having a mounting fixture 91*d* mounted on the free end thereof, and a dust shield 91*e* mounted on the exposed end of rod portion 91*c*. Basically, dust shield 91*e* includes an annular end portion secured to the exposed end of rod portion 91*c* and a cylindrical portion secured to the annular portion. The cylindrical portion of the dust shield has a length sufficient to overlie the juncture of the exposed portion of the rod and the cylinder for the full range of displacement of the rod relative to the cylinder so that during normal operation of the assembly, the dust shield will shield such juncture from the environment thus preventing contaminants from lodging on the rod and being carried into the cylinder. To further assure against the entry of contaminants between the dust shield and the cylinder, pressurized air may be injected into the dust shield which would be ejected through the annular space between the shield and the cylinder forming a pneumatic seal therebetween. Similarly, assembly 92 includes a cylinder portion 92*a* having a mounting fixture 92*b* mounted on the free end thereof, a rod portion 92*c* having a mounting fixture 92*d* mounted on the free end thereof and a dust shield 92*e* which functions in the same manner as dust shield 91*e***.

Actuating assemblies 91 and 92 are mounted on the upper side of stiffleg 17, between beam sections 22 and 23. The lower ends thereof are pivotally connected to connecting section 26 of the stiffleg by means of mounting pins 95 and 96 journaled in bosses provided in plate member 32 and aligned openings in plate members 26 and 29. As best illustrated in FIG. 5, connecting pins 95 and 96 are provided with spherical bushings to permit limited universal movement of the lower ends of actuating assemblies 91 and 92 relative to the connecting pins and the lower end of the stiffleg. The upper ends of the assemblies are pivotally connected to the hoist frame by means of a connecting pin 97 mounted in lugs 59, 60 and 61 and passing through mounting fixtures **91*d* and 92*d* of rods 91*c* and 92*c*** of the assemblies.

Actuating assemblies 93 and 94 also are similar in construction. Assembly 93 consists of a cylinder portion **93*a* having a mounting fixture 93*b* mounted on the free end thereof, a rod portion 93*c* having a mounting fixture 93*d* mounted on the free end thereof and a dust shield 93*e*. Similarly, assembly 94 is provided with cylinder portion 94*a* having mounting fixture 94*b*, rod portion 94*c* having mounting fixture 94*d* and a dust shield 94*e*. Assemblies 93 and 94 are mounted on the underside of the stiffleg, between beam sections 22 and 23. The lower ends of the assemblies are universally mounted on spherical bushings provided on connecting pins 95 and 96, and the upper ends thereof are connected to axially align pins 98 and 99 mounted on the lower ends of links 69 and 70** of the hoist frame.

Actuating assemblies 91 through 94 are of a single-acting type. The fluid supply system forming part of the hoist system can be of any suitable type which will simultaneously provide fluid under pressure to the cylinder ends of push-type assemblies 93 and 94 and to the rod ends of pull-type assemblies 91 and 92 to effect a hoisting motion of the dipper. It will be appreciated that by supplying fluid under pressure to the cylinder ends of assemblies 93 and 94 and to the rod ends of assemblies 91 and 92, rods **93*c* and 94*c* will be caused to extend and rods 91*c* and 92*c*** will be caused to retract to pivot the hoist frame and correspondingly the handle, dipper and hoist link about the axis of the head shaft to effect the hoist motion. Any suitable fluid supply system with any suitable form of controls may be used within the scope of the present invention. While the embodiment described herein utilizes the combination of two equally-sized pull-type assemblies mounted on the upper side of the stiffleg and two equally-sized push-type cylinders on the underside of the stiffleg to effect the hoisting motion, it is to be understood that any combination of numbers and sizes of cylinders can be used within the scope of the invention to provide the desired hoisting motion.

The machine as illustrated in FIG. 1 with the dipper disposed adjacent the lower end of the stiffleg is in a condition to begin an operating cycle. The rear end of the dipper is prevented from engaging and thus possibly damaging the lower end of the stiffleg by means of a bumper device 100 mounted on the lower front end of the stiffleg. The bumper device is provided with a resilient material 101 which is adapted to engage the dipper when it is being retracted and to cushion the impact of its motion. To commence the operating cycle of the machine, the operator manipulates appropriate controls at the operator's station on the machine to permit fluid to flow from the cylinder ends of actuating assemblies 90 of the crowd system. Under such conditions, the weight of the front end assembly will cause the stiffleg to pivot forwardly, simultaneously moving the dipper into the material being excavated. Simultaneously with the commencement of the crowding action of the dipper, appropriate controls are operated to effect limited hoisting motion of the dipper. This is accomplished by supplying fluid under pressure to the cylinder ends of push-type assemblies 93 and 94 of the hoist system and to the rod ends of pull-type cylinders 91 and 92. As the dipper is crowded into the bank of material being loaded, the combined crowding and hoisting action causes it to make a flat pass. At the same time, pitch control system 79 causes the pitch of the dipper to remain constant relative to the ground. At the end of the crowd phase of the cycle, the pitch control mechanism is released to cause the dipper to pitch upwardly and thus ensure a full load of material being loaded. The upward pitch of the dipper is restricted by pitch control system 80 in a manner as described in the aforementioned patent relating to such system.

After the dipper has been pitched upwardly, the controls for the crowd and hoist systems and swing machinery are operated to position the dipper above the dump body of a hauling vehicle or another suitable repository for the material where the door of the dipper is tripped to cause the door to open and the material to be unloaded. The desired retracting motion of the front end assembly is effected by supplying fluid under pressure to the cylinder ends of actuating assemblies 90 of the crowd system. Such action results in the extension of the rods of such assemblies to pivot the support links 83 rearwardly, simultaneously causing the front end to pivot rearwardly about the pivotal connection of the stiffleg to the upper frame of the machine. Accelerated hoisting motion is effected by increasing the volume of fluid to the cylinder ends of assemblies 93 and 94 and the rod ends of assemblies 91 and 92.

As soon as the material has been dumped, the swing machinery can be operated to rotate the front end of the machine back to the embankment, the crowd system can be operated to continue to retract the front end assembly and the fluid under pressure supplied to the hoist cylinders can be throttled down to permit the dipper handle to swing downwardly at a controlled rate until it again is positioned as shown in FIG. 1, ready to begin another operating cycle.

During the operating cycle as described, loads in tension, compression and bending imposed upon the dipper are transmitted through the dipper handle, the base portion of the hoist frame, the head shaft, the stiffleg and the foot pins into the upper frame of the machine. Loads applied to the side of the dipper as when the dipper may be swung sideways into a large rock, are translated through the stiffleg as torsional loads relative to the center line of the stiffleg. Such torsional loads are dampened by the deflection or limbering action of the stiffleg and further cushioned by the cushioning pads provided on the feet of the stiffleg thus diminishing, if not eliminating, the transmission of such loads to the upper frame of the machine. Horizontal shear loads imposed on the front end assembly are resisted by web 25 interconnecting the beam sections 22 and 23 of the stiffleg.

The invention as described has a substantial number of advantages over prior art machines provided with conventional rope hoist systems. The initial apparent advantage is that the elimination of heavy-duty gearing, a hoist drum, sheaves mounted on the front end assembly and a rope wound on the hoist drum and reeved on the sheaves results in reductions in cost and space requirements, a reduction in the static and dynamic loading on the front end assembly and correspondingly an improved operating performance of the machine. Bearing loads on the head shaft are minimized because the major load on the bearings is only the difference between the push and pull forces imposed on the head shaft by the hoist cylinders. The invention permits the use of relatively short-stroke cylinders with correspondingly shorter operating arms. Thus, the upper assemblies are not caused to rise high enough to interfere with the operator's vision, nor do the lower actuating assemblies protrude far enough out from the stiffleg to place them in danger of collision with a truck or other object located near the machine.

In the prior art, machines of the type described have been provided with a resilient joint in the upper end of the handle to alleviate the effects of torsional loads applied on the dipper handle. The present invention permits such resilient joint to be relocated at the foot of the stiffleg thus improving the load distribution on the front end assembly. Also, in conventional machines of the type described utilizing a rope hoist system, there usually is employed a pair of crowd links interconnecting the upper end of the mast and the hoist frame. Because the stiffleg of the present invention is allowed to roll on its own axis, only a single crowd link is allowed, which may be provided with ball joint connections with the hoist frame and the upper end of the mast.

Perhaps the greatest advantage of the present invention, however, is that it provides for an all-hydraulically-powered machine in a class of large, heavy-duty mining shovels which heretofore has not been available as a practical matter. Such heavy-duty shovels consist of shovels having capacities of twenty cubic yards and more.

From the foregoing detailed description, it will be evident that there are a number of changes, adaptations and modifications of the present invention which fall within the province of those persons skilled in the art. However, it is intended that all such variations not departing from the spirit of the invention be considered as within the scope thereof as limited solely by the appended claims.

We claim:

1. A power shovel comprising a support unit, a stiffleg operatively connected to said support unit for pivotal movement about a stiffleg pivot axis, a handle operatively connected to said stiffleg for pivotal movement about a handle pivot axis, a dipper mounted on said handle, a crowd system operatively connected to said handle for crowding and retracting said dipper and a hoist system for hoisting and lowering said dipper comprising at least one upper fluid actuated rod and cylinder assembly operatively connected at a lower end thereof to said stiffleg and operatively connected at an upper end thereof to said handle on one side of said handle pivot axis, at least one lower fluid actuated rod and cylinder assembly operatively connected at a lower end thereof to said stiffleg and operatively connected at an upper end thereof to said handle on a side opposite to the operative connection of the upper end of said upper fluid actuated assembly and said handle, relative to said handle pivot axis, and means for selectively supplying fluid under pressure to opposite ends of said fluid actuated assemblies to effect an extension and retraction of the rods of said fluid actuated assemblies to correspondingly effect a pivotal movement of said handle about said handle pivot axis.

2. A power shovel according to claim 1 wherein the lower ends of said fluid actuated members are connected to said stiffleg adjacent said stiffleg pivot axis.

3. A power shovel according to claim 1 wherein the upper ends of said fluid actuated assemblies are operatively connected to said handle adjacent said handle pivot axis.

4. A power shovel according to claim 1 wherein the lower ends of said fluid actuated assemblies are connected to said stiffleg adjacent said stiffleg pivot axis, and the upper ends of said fluid actuated assemblies are operatively connected to said handle adjacent said handle pivot axis.

5. A power shovel according to claim 1 wherein the rods of said fluid actuated assemblies are provided with cover members projecting over the cylinder portions thereof for shielding rod portions receivable in the cylinder portions of said assemblies from contaminants in the environment.

6. A power shovel according to claim 5 including means for injecting pressurized air into said cover members for expelling contaminants therefrom.

7. A power shovel according to claim 1 wherein said stiffleg is universally connected to foot members trunion mounted on said support unit and said stiffleg is provided with means interposed between said stiffleg and said foot members for cushioning torsional loads imposed on said dipper and transmitted to said stiffleg.

8. A power shovel according to claim 1 wherein said stiffleg includes a pair of transversely spaced beam sections and an interconnecting cross-piece section.

9. A power shovel according to claim 8 wherein said interconnecting cross-piece section is disposed adjacent said stiffleg pivot axis.

10. A power shovel according to claim 9 wherein the lower ends of said fluid actuating assemblies are pivotally connected to said interconnecting cross-piece member.

11. A power shovel comprising a support unit, a stiffleg operatively connected to said support unit for pivotal movement about a stiffleg pivot axis, a hoist frame operatively connected to said stiffleg for pivotal movement about a hoist frame pivot axis, a handle operatively connected to said hoist frame, a dipper mounted on said handle, a hoist link operatively interconnecting said hoist frame and dipper, a crowd system operatively connected to said hoist frame for crowding and retracting said dipper and a hoist system for hoisting and lowering said dipper comprising at least one upper fluid actuated rod and cylinder assembly operatively connected at a lower end thereof to said stiffleg and operatively connected at an upper end thereof to said hoist frame on one side of said hoist frame pivot axis, at least one lower fluid actuated rod and cylinder assembly operatively connected at a lower end thereof to said stiffleg and operatively connected at an upper end thereof to said hoist frame on a side opposite to the operative connection of the upper end of said upper fluid actuated assembly to said hoist frame, relative to said hoist frame pivot axis, and means for selectively supplying fluid under pressure to opposite sides of said fluid actuated assemblies to effect an extension and retraction of the rods of said fluid actuated assemblies to correspondingly effect a pivotal movement of said hoist frame about said hoist frame pivot axis.

12. A power shovel according to claim 11 wherein the lower ends of said fluid actuated assemblies are connected to said stiffleg adjacent said stiffleg pivot axis.

13. A power shovel according to claim 11 wherein the upper ends of said fluid actuated assemblies are operatively connected to said hoist frame adjacent said hoist frame pivot axis.

14. A power shovel according to claim 11 wherein the lower ends of said fluid actuated assemblies are connected to said stiffleg adjacent said stiffleg pivot axis and the upper ends of said fluid actuated assemblies are operatively connected to said hoist frame adjacent said hoist frame pivot axis.

15. A power shovel according to claim 11 wherein the rods of said fluid actuated assemblies are provided with cover members projecting over the cylinder portions thereof for shielding rod portions receivable in the cylinder portions of said assemblies from contaminants in the environment.

16. A power shovel according to claim 15 including means for injecting pressurized air into said cover members for expelling contaminants therefrom.

17. A power shovel according to claim 11 wherein said stiffleg is universally connected to foot members trunion mounted on said support unit and said stiffleg is provided with means interposed between said stiffleg and said foot members for cushioning torsional loads imposed on said dipper and transmitted to said stiffleg.

18. A power shovel according to claim 11 wherein said stiffleg includes a pair of transversely spaced beam sections and an interconnecting cross-piece section.

19. A power shovel according to claim 18 wherein said interconnecting cross-piece section is disposed adjacent said stiffleg pivot axis.

20. A power shovel according to claim 19 wherein the lower ends of said fluid actuated assemblies are pivotally connected to said interconnecting cross-piece member.

21. A power shovel according to claim 11 wherein said crowd system includes a mast pivotally connected to said support unit, means mounted on said support unit for pivoting said mast and means operatively interconnecting said mast and said hoist frame for transmitting pivotal motion of said mast to said hoist frame.

22. A power shovel according to claim 21 wherein said means for transmitting pivotal motion of said mast to said hoist frame comprises a rigid link universally connected at its ends to said mast and said hoist frame.

* * * * *

UNITED STATES PATENT AND TRADEMARK OFFICE

CERTIFICATE OF CORRECTION

PATENT NO. : 4,464,093

DATED : Aug. 7, 1984

INVENTOR(S) : George B. Baron et al

It is certified that error appears in the above-identified patent and that said Letters Patent is hereby corrected as shown below:

On the title page, Item /54/ should read:

POWER SHOVEL HAVING IMPROVED HOIST SYSTEM

Signed and Sealed this

*Fifth* Day of *March 1985*

[SEAL]

*Attest:*

DONALD J. QUIGG

*Attesting Officer* *Acting Commissioner of Patents and Trademarks*